US011759720B1

(12) United States Patent
Ziegler

(10) Patent No.: US 11,759,720 B1
(45) Date of Patent: Sep. 19, 2023

(54) SLIDING FIDGET TOY

(71) Applicant: Austin Ziegler, Tigard, OR (US)

(72) Inventor: Austin Ziegler, Tigard, OR (US)

( * ) Notice: Subject to any disclaimer, the term of this patent is extended or adjusted under 35 U.S.C. 154(b) by 135 days.

(21) Appl. No.: 17/172,848

(22) Filed: Feb. 10, 2021

(51) Int. Cl.
*A63H 33/26* (2006.01)
*H01F 7/02* (2006.01)

(52) U.S. Cl.
CPC ..... *A63H 33/26* (2013.01); *H01F 7/0205* (2013.01)

(58) Field of Classification Search
CPC ..... A63H 33/00; A63H 33/26; H01F 7/0205
USPC ..... 446/129, 132, 133, 134, 135, 137, 138
See application file for complete search history.

(56) References Cited

U.S. PATENT DOCUMENTS 1,005,853 A * 10/1911 Lewis ..... A63H 33/26 446/132
2,818,680 A * 1/1958 Borsos ..... A63H 33/26 472/57
2,994,984 A * 8/1961 Luchsinger ..... A63H 33/26 446/132
3,995,855 A * 12/1976 Schultz ..... A63B 43/04 473/594
4,031,660 A * 6/1977 Chen ..... A63H 33/26 446/485
4,194,737 A * 3/1980 Farmer ..... A63H 33/005 473/570
4,200,283 A * 4/1980 Andrews ..... A63F 9/16 446/259
4,233,777 A * 11/1980 Inoue ..... A63H 17/22 446/131
4,486,729 A * 12/1984 Lee ..... F16C 32/0425 446/133
4,531,923 A * 7/1985 Lohr ..... A63H 33/26 273/109
4,575,346 A * 3/1986 Ogawa ..... A63H 1/06 446/259
4,753,623 A * 6/1988 Krut ..... A63H 33/26 446/256
4,756,530 A * 7/1988 Karman ..... A63F 7/042 273/156
4,822,044 A * 4/1989 Perkitny ..... A63F 9/34 273/118 A
4,871,340 A * 10/1989 Ross ..... A63H 33/26 446/132
4,917,644 A * 4/1990 Sunshine ..... A63H 33/26 446/26
5,135,425 A * 8/1992 Andrews ..... A63H 33/26 446/133
5,152,711 A * 10/1992 Gross ..... A63H 33/26 446/139
5,184,970 A * 2/1993 Binkley ..... A63H 33/26 446/132
5,506,459 A * 4/1996 Ritts ..... F16C 39/063 446/256
5,540,187 A * 7/1996 Udelle ..... A01K 15/025 119/706

(Continued)

*Primary Examiner* — Alexander R Niconovich
(74) *Attorney, Agent, or Firm* — PATENTTM.US

(57) ABSTRACT

A fidget toy comprises a rolling magnet inside a case designed to be hand held. The case holds a fixed magnet therein defining a rolling seat for the rolling member, which may comprise a magnet, the rolling magnet allowed to roll within a track defined inside said case while rolling against the peripheral face of the fixed magnet. Viewing openings are defined in the case for allowing a user to observe and interact with the rolling magnet as it moves.

22 Claims, 6 Drawing Sheets

(56) References Cited

U.S. PATENT DOCUMENTS

| | | | | |
|---|---|---|---|---|
| 5,591,062 | A | 1/1997 | Hettinger | |
| 6,150,913 | A * | 11/2000 | Simmons | G09F 19/02 446/132 |
| 7,275,974 | B2 * | 10/2007 | Perry | A63H 33/26 273/109 |
| 7,575,498 | B2 * | 8/2009 | Perry | A63H 33/26 273/109 |
| 10,039,993 | B2 * | 8/2018 | Antolin | A63H 33/26 |
| 10,293,633 | B2 * | 5/2019 | Hoffman | B43K 29/005 |
| 10,307,687 | B2 * | 6/2019 | Umberger | A63H 33/26 |
| 10,449,466 | B2 * | 10/2019 | Kinmont, Jr. | A63H 1/00 |
| 10,625,172 | B2 * | 4/2020 | Mak | A63H 33/00 |
| 10,913,008 | B2 * | 2/2021 | Hamel | A63H 33/00 |
| 10,966,898 | B2 * | 4/2021 | Nichols | A61H 7/001 |
| 11,123,649 | B1 * | 9/2021 | Kownacki | A63H 33/00 |
| 11,484,811 | B2 * | 11/2022 | Cantoli-Alves | A63H 33/26 |
| 2007/0298677 | A1 * | 12/2007 | Hoffman | A63H 33/26 446/129 |
| 2008/0057821 | A1 * | 3/2008 | Perry | A63H 1/02 446/46 |
| 2018/0342930 | A1 * | 11/2018 | Roberts | H02K 7/1861 |
| 2018/0345156 | A1 * | 12/2018 | Bornstein | A63H 1/20 |
| 2019/0038991 | A1 * | 2/2019 | Schiraga | A63H 1/00 |
| 2019/0105578 | A1 * | 4/2019 | Brous | A63H 13/20 |
| 2019/0358559 | A1 * | 11/2019 | Bennett | A63H 33/26 |

* cited by examiner

SLIDING FIDGET TOY

BACKGROUND

This disclosure relates to toys, and more particularly to a fidget toy that has moving parts to provide entertainment.

Fidget toys, such as the fidget spinner with a central stationary portion around which a spinning component can be freely rotated by use of bearings, can provide entertainment. The popularity of such devices increased significantly in 2017.

SUMMARY

In accordance with the disclosure, a fidget toy is provided in a case having openings through which a moving member can be observed, the member being set into movement by a user moving and shaking the case or physically sliding the moving member through said openings. The moving member is comprised of a circular or spherical configuration magnet, with the case holding a stationary magnet that provides a rolling track against which the moving magnet travels in a cyclical fashion, around and around inside the case.

The subject matter of the present technology is particularly pointed out and distinctly claimed in the concluding portion of this specification. However, both the organization and method of operation, together with further advantages and embodiments thereof, may best be understood by reference to the following description taken in connection with accompanying drawings wherein like reference characters refer to like elements.

DETAILED DESCRIPTION

The system according to a preferred embodiment of the present disclosure comprises fidget toy having a case that reveals a traveling member in the form of a circular or spherical magnet that moves around and around on a track defined by a stationary magnet held in the case.

Figure 1:
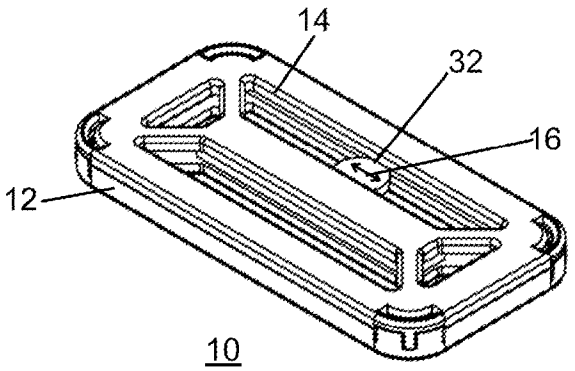
FIG. 1 is a perspective view of a fidget toy in accordance with the disclosure.

Referring to FIG. 1, a perspective view of a fidget toy in accordance with the disclosure, the toy 10 comprises a case 12 having openings 14 defined therein (14' on the other face of the case) through which a movable member 16 is visible. The openings can be optionally sealed with a transparent cover to allow viewing into the case while not allowing direct touching of the internal contents of the case.

Figure 2:
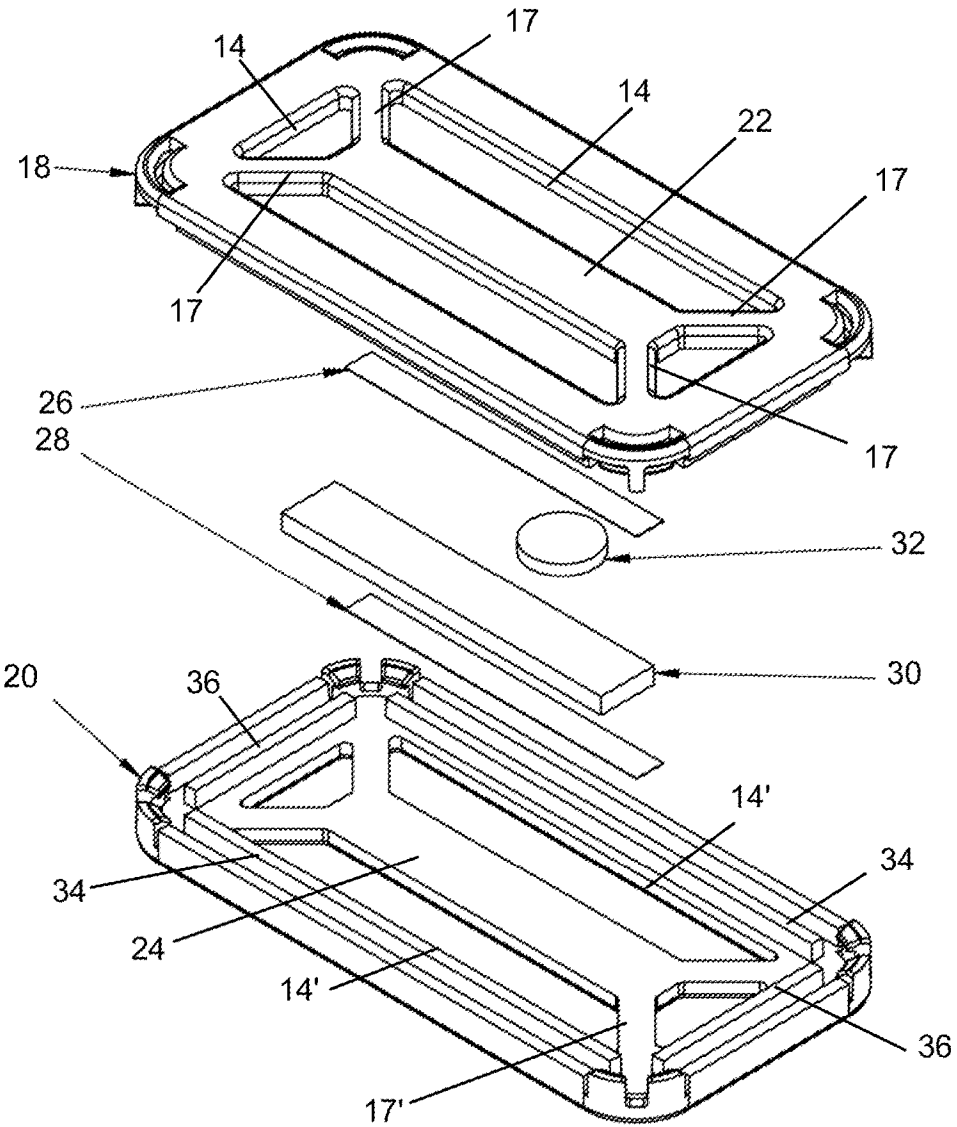
FIG. 2 is an exploded perspective view of a fidget toy of FIG. 1.

Referring now to FIG. 2, an exploded perspective view of the fidget toy of FIG. 1, the toy comprises first (top) and second (bottom) case members 18, 20, which snap together to engage each other and hold together when in assembled form. The case members have central portions 22, 24, held in position relative to the case members 18, 20 by supports 17, 17'. The central portions define flat surfaces against which adhesives 26, 28 may be positioned, on the interior faces of the central portions, so as to mount stationary magnet/track 30 thereagainst. The case members are designed such that when snapped together, the space between the inner faces of portions 22 and 24 are of appropriate dimension so as to accommodate the thickness of the magnet 30 therewithin, to secure the magnet with the adhesive against movement from position between the two central portions. A circular disk-shaped magnet 32 is positioned in the case so as to abut against the outer periphery of magnet 30.

Case member 20 has raised perimeter channel wall portions 34 along the left and right outer edges of openings 14 on the longer edges of the case and raised perimeter channel wall portions 36 along the front and back outer edges of openings 14 on the shorter edges of the case. The distance between the openings and the perimeter channel wall portions is defined to create a space to accommodate the disk magnet 32 between the peripheral edges of magnet 30 when secured to the case and the perimeter channel wall portions, such that the magnet 32 is free to roll along the peripheral faces of magnet 30, but remain contained within the case between magnet 30 and channel walls 34, 36.

To assemble the device, with the two case portions 18, 20 separate, case portion 20 is laid flat on a work surface and adhesive member 28 is positioned on the inner face of portion 24 of case member 20. Magnet 30 is placed against the adhesive 28 and then the second adhesive portion 26 is pressed against the face of the magnet 30 opposite the face adhered by adhesive 28. Magnet 32 is positioned on the inner face of case portion 20, between the magnet 30 and the raised perimeter channel wall portions 34, 36. Then ensure proper magnet 30 positioning by sliding magnet 32 completely around the peripheral edge of magnet 30 without friction or pinching between magnet 30 and the channel wall portions. The upper case portion 18 is then lowered into position over lower case portion 20, and the two case portions are snapped together, as the case portions are provided with snap fittings so as to securely join together. Once so joined, the case portions are not intended to be separated again, providing the device as a single assembled piece with moving magnet 32 contained therewithin.

With the device so assembled, magnet 32 is free to roll along the peripheral edges of magnet 30, along channels defined between magnet 30 and channel walls 34, 36. Magnet 32 is visible through the openings 14 as the magnet moves, but contained within the case so as to not fall out. The magnet 32 will travel around and around the outer edge of magnet 30 by a user moving the case to effect the movements, or physically moving said magnet through openings.

Figure 6:
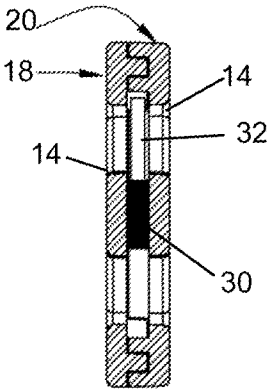
FIG. 6 is a sectional view of a fidget toy in taken along line A-A of FIG. 5.
Figure 4:
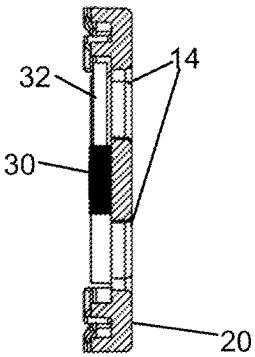
FIG. 4 is a sectional view of a fidget toy taken along line B-B of FIG. 3.
Figure 5:
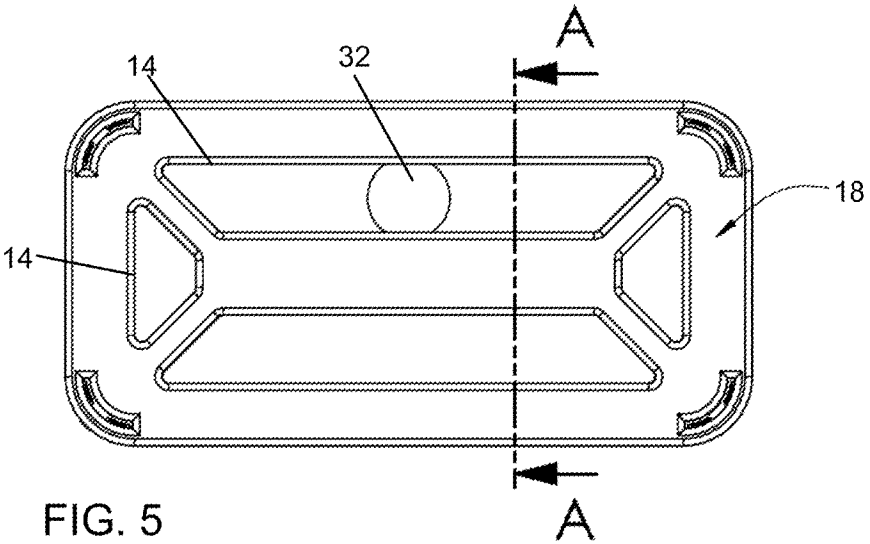
FIG. 5 is a top plan view of a fidget toy of FIG. 1.
Figure 3:
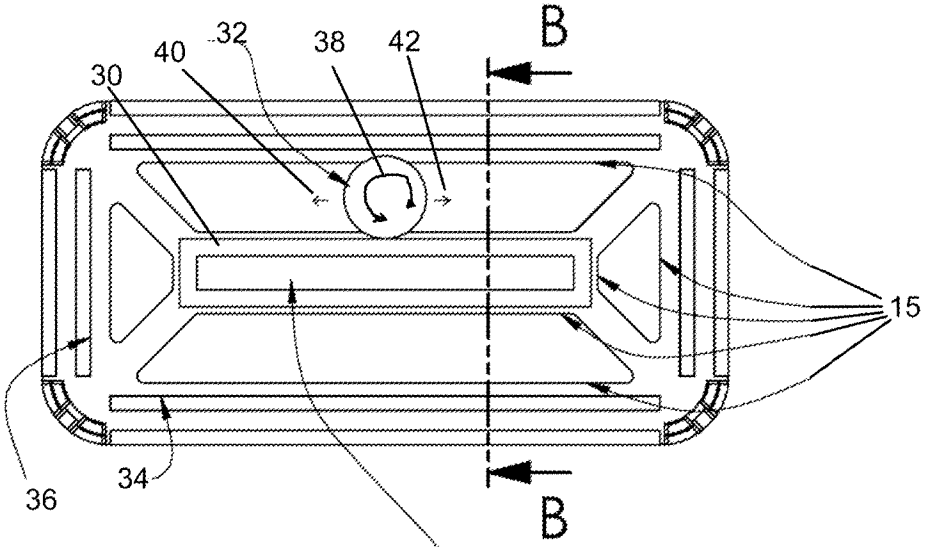
FIG. 3 is a top plan view of the bottom enclosure of FIG. 1.

FIG. 3 is a top plan view of the bottom enclosure in accordance with the disclosure prior to placement of the top enclosure, wherein it may be observed that the circular magnet 32 is free to roll as shown by arc 38 along the peripheral face edges of magnet 30, traveling in either direction 40 or 42. The edge walls 15 of the case adjacent openings 14 extend a sufficient distance to ensure the magnet 32 stays within the assembled enclosure, while perimeter channels 34, 36 provide a structure for the moving magnet to stay close to the magnet 30. Further views are provided by FIG. 4, a sectional view of the fidget toy taken along line B-B of FIG. 3, while FIG. 5 is a top plan view of the fully assembled fidget toy and FIG. 6 is a sectional view taken along line A-A of FIG. 5.

Figure 7:
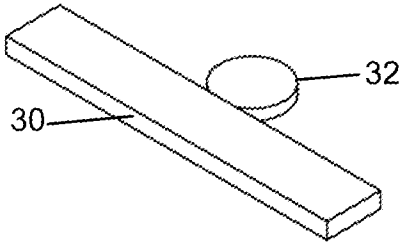
FIG. 7 is a perspective view of the relationship between the magnets when assembled in the case, with the case removed for this view.
Figure 8:
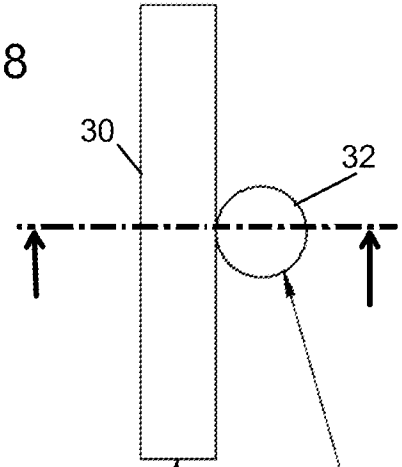
FIG. 8 is a top plan view of the relationship of the magnets of FIG. 7.
Figure 9:
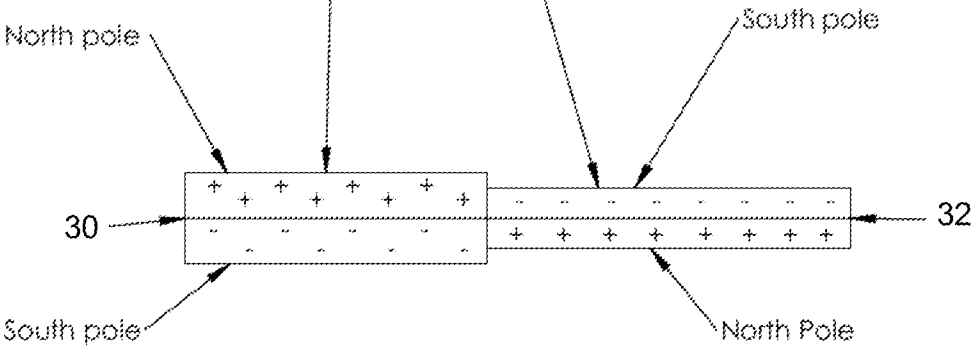
FIG. 9 is a sectional view taken along line C-C of FIG. 8 showing the polarity of the magnets.

The relationship between the magnets is better understood with reference to FIGS. 7-9, where FIGS. 7 and 8 are a perspective and top view of the relationship between the magnets 30 and 32 when the device is assembled, with the case removed in the views, wherein the magnet 32 is able to move along the peripheral edges of magnet 30, the edges of magnet 30 acting as a track against which magnet 32 is free to roll. Looking to FIG. 9, a sectional view taken along line C-C of FIG. 8 showing the polarity of the magnets, the magnets are positioned such that one pole of the magnet 30 is oriented upwardly, the north pole in the illustration, while magnet 32 is positioned such that its opposite pole is oriented upwardly, the south pole in the illustration. So, the magnets attract one another so as to keep the moving magnet 32 attracted to be against the peripheral edge faces of magnet 30, while still allowing magnet 32 to roll along the magnet 30 faces.

In accordance with the disclosure, the devices uses magnetic polarity such that a round magnet gets stacked on an adjacent edge of another larger magnet (either rectangular, ovular, round, any shape, with attendant shape changes to the case also possible) with the polarity facing the opposite direction. These polarity differences allow the round magnet to move around the larger magnet, enabling a quick sliding/rolling motion to be imparted to the round magnet, with the enclosure encasing both magnets within, so neither magnet can be removed. The larger magnet (which is not visible through the case when assembled, unless a transparent case material is employed) is permanently adhered to the enclosure, thus cannot be removed. The rolling magnet, is visible through the enclosure cutouts to allow the user to see and interact with the rolling magnet in action. The rolling magnet is covered by at least 10% overhang on each edge of the enclosure ensuring that the magnet cannot unintentionally pop out of the enclosure with the amount of force that would happen during normal use. The top and bottom enclosure are permanently snapped together where the snaps are contained on the inside of the device, and thus would not be able to be accessed to unsnap the enclosure without breaking the device. While the preferred embodiment has the $2^{nd}$ magnet in circular disk form, other shapes can be employed, such as a spherical shaped $2^{nd}$ magnet as discussed below, for example. In an alternative embodiment, magnet 32 can, instead of being a magnet, be made of a ferrous metal, wherein only the attraction of magnet 30 is relied on to keep the rolling portion 32 in contact with magnet 30.

Figure 10:
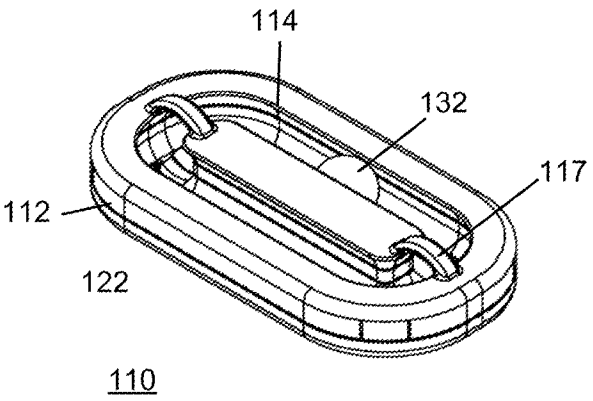
FIG. 10 is a perspective view of an alternative fidget toy with a spherical moving member.

Referring to FIG. 10 is a perspective view of an alternative fidget toy with a spherical moving magnet, this alternative version shares some features of the first mentioned embodiment 10, but employs a spherical moving magnet. This toy 100 comprises a case 112 having openings 114 defined therein (114' on the other face of the case) through which a movable member 116 is visible.

Figure 11:
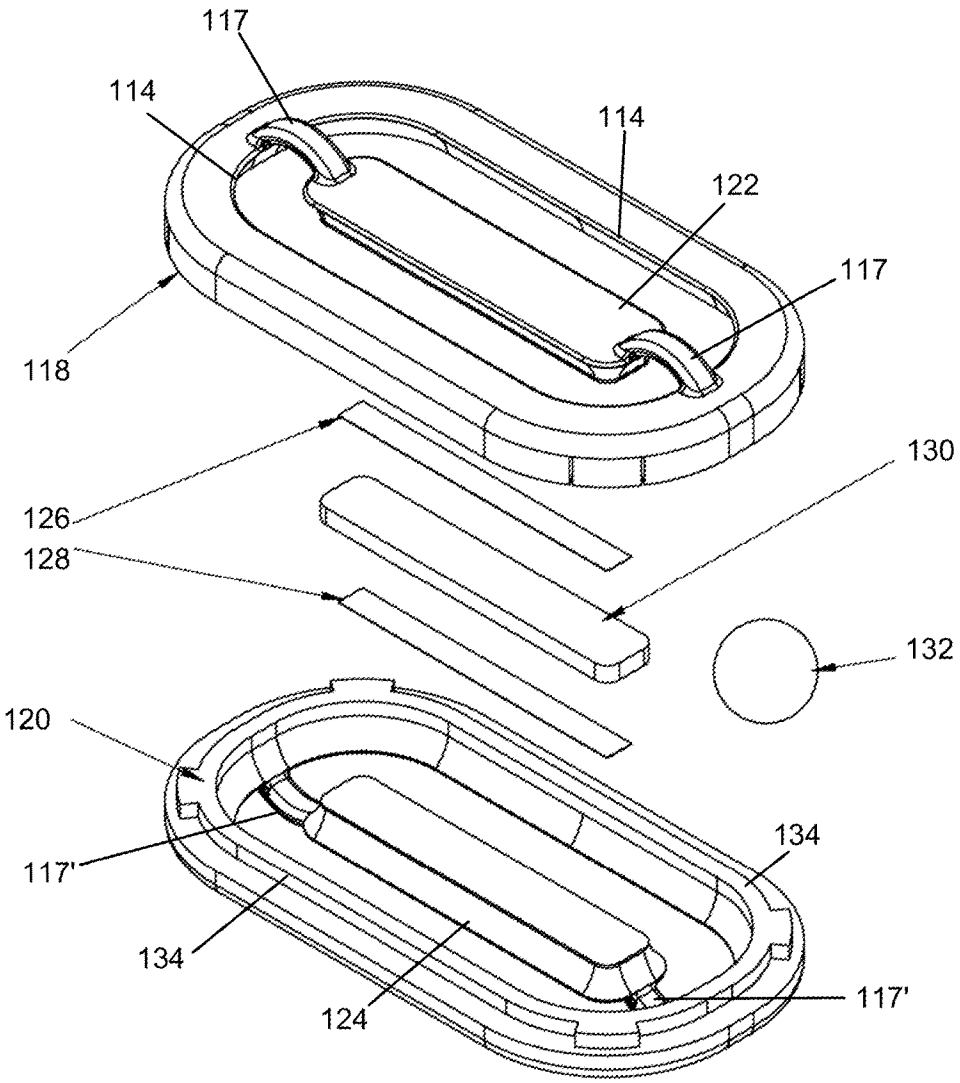
FIG. 11 is an exploded perspective view of the fidget toy of FIG. 10.

Referring now to FIG. 10 together with FIG. 11, an exploded perspective view of the fidget toy of FIG. 10, the toy comprises first (top) and second (bottom) case members 118, 120, which snap together to engage each other and hold together when in assembled form. The case members have central portions 122, 124 which are held in position relative to the case members 118, 120 by arched supports 117, 117'. The central portions 122, 124 define flat surfaces against which adhesives 126, 128 may be positioned, on the interior faces of the central portions, so as to mount stationary magnet/track 130 thereagainst. The case members are designed such that when snapped together, the space between the inner faces of portions 122 and 124 are of appropriate dimension so as to accommodate the thickness of the magnet 130 therewithin, to secure the magnet with the adhesive against movement from position between the two central portions. A spherical-shaped magnet 132 is positioned in the case so as to abut against the outer periphery of magnet 130.

Case member 120 has curved perimeter channel wall portions 134 along the edges of openings 114, 114'. The distance between the openings and the perimeter channel wall portions is defined to create a space to accommodate the spherical magnet 132 between the peripheral edges of magnet 130 when secured to the case and the perimeter channel wall portions, such that the magnet 132 is free to roll along the peripheral faces of magnet 130, but remain contained within the case between magnet 130 and channel walls 134.

To assemble the device, with the two case portions 118, 120 separate, case portion 120 is laid flat on a work surface and adhesive member 128 is positioned on the inner face of portion 124 of case member 120. Magnet 130 is placed against the adhesive 128 and then the second adhesive portion 126 is pressed against the face of the magnet 130 opposite the face adhered by adhesive 128. Magnet 132 is positioned on the inner face of case portion 120, between the magnet 130 and the perimeter channel wall portions 134. Then ensure proper magnet 130 positioning by sliding magnet 132 completely around the peripheral edge of magnet 130 without friction or pinching between magnet 130 and the channel wall portions. The upper case portion 118 is then lowered into position over lower case portion 120, and the two case portions are snapped together, as the case portions are provided with snap fittings so as to securely join together. Once so joined, the case portions are not intended to be separated again, providing the device as a single assembled piece with moving magnet 132 contained therewithin.

With the device so assembled, magnet 132 is free to roll along the peripheral edges of magnet 130, along channels 135 defined between magnet 130 and channel walls 134. Magnet 132 is visible through the openings 114 as the magnet moves, but contained within the case so as to not fall out. The magnet 132 will travel around and around the outer edge of magnet 130 by a user moving the case to effect the movements, or physically moving said magnet through the openings 114.

Figure 15:
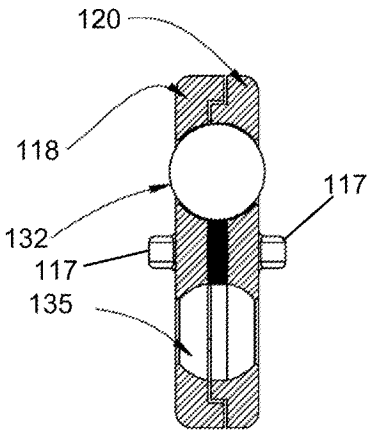
FIG. 15 is a sectional view of the fidget toy taken along line D-D of FIG. 14.
Figure 13:
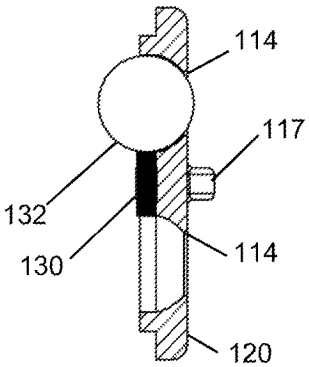
FIG. 13 is a sectional view of a fidget toy in accordance with the disclosure taken along line E-E of FIG. 12.
Figure 14:
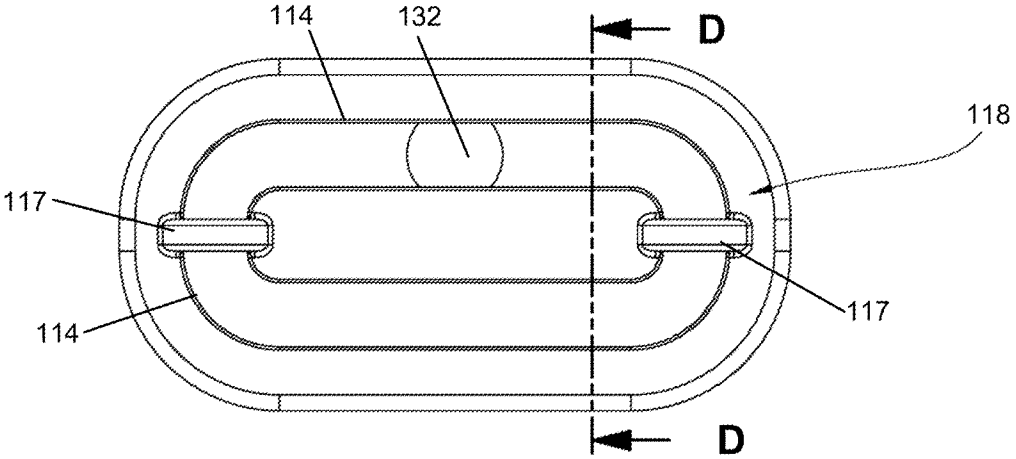
FIG. 14 is a top plan view of the fidget toy of FIG. 10.
Figure 12:
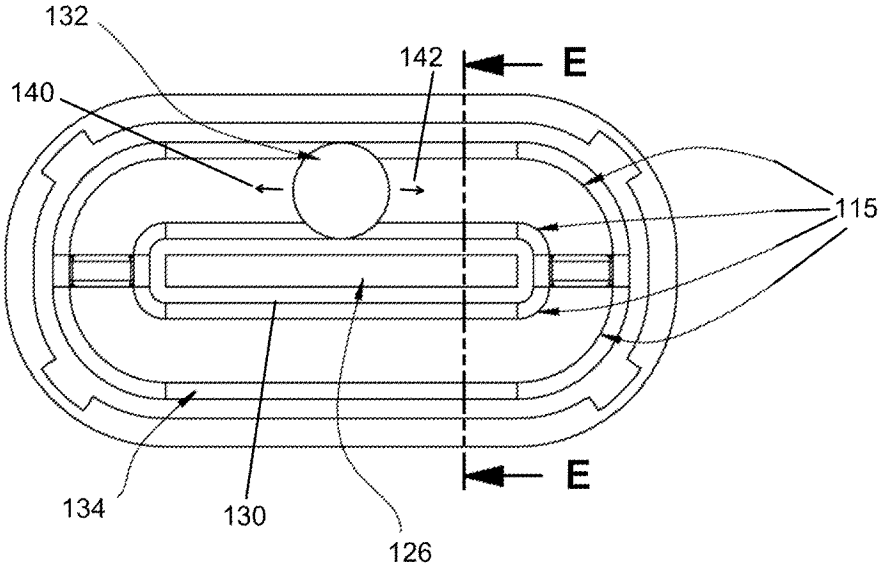
FIG. 12 is a top plan view of the bottom enclosure of the fidget toy of FIG. 10.

FIG. 12 is a top plan view of the bottom enclosure in accordance with the spherical magnet version prior to placement of the top enclosure, wherein it may be observed that the spherical magnet 132 is free to roll as shown by arrow 138 along the peripheral face edges of magnet 130, traveling in either direction 140 or 142. The edge walls 115 of the case adjacent openings 14 extend a sufficient distance to ensure the magnet 132 stays within the assembled enclosure, while perimeter channels 134 provide a structure for the moving magnet to stay close to the magnet 130. Further views are provided by FIG. 13, a sectional view of the fidget toy taken along line E-E of FIG. 12, while FIG. 14 is a top plan view of the fully assembled fidget toy and FIG. 15 is a sectional view taken along line D-D of FIG. 14.

Magnet 132 can, instead of being a magnet, be made of a ferrous metal, wherein only the attraction of magnet 130 is relied on to keep the rolling portion 132 in contact with magnet 130. In corresponding fashion to the embodiment of FIGS. 1-9, the central/fixed magnet 130 can be other than rectangular, such as circular, ovoid, or other shapes, and the overall shape of the case can be modified as well.

In accordance with the disclosure, the device uses magnetic polarity such that a round or spherical magnet gets stacked on an adjacent edge of another larger magnet (either rectangular, ovular, round, any shape) with the polarity facing the opposite direction. These polarity differences allow the round magnet to move around the larger magnet, enabling a quick sliding/rolling motion to be imparted to the round magnet, with the enclosure encasing both magnets within, so neither magnet can be removed. The larger magnet (which is not visible through the case unless transparent case materials are used) is permanently adhered to the enclosure, thus cannot be removed. The rolling magnet is visible through the enclosure cutouts to allow the user to see and interact with the rolling magnet in action. The rolling magnet is covered by at least 10% overhang on each edge of the enclosure ensuring that the magnet cannot unintentionally pop out of the enclosure with the amount of force that would happen during normal use. The top and bottom enclosure are permanently snapped together where the snaps are contained on the inside of the device, and thus would not be able to be accessed to unsnap the enclosure without breaking the device. While the preferred embodiment has the $2^{nd}$ magnet in circular disk form, other shapes can be employed, such as a spherical shaped $2^{nd}$ magnet (or ferrous metal sphere), for example. In an alternative embodiment, magnet 132 can, instead of being a magnet, be made of a ferrous metal, wherein only the attraction of magnet 130 is relied on to keep the rolling portion 132 in contact with magnet 130.

Figure 16:
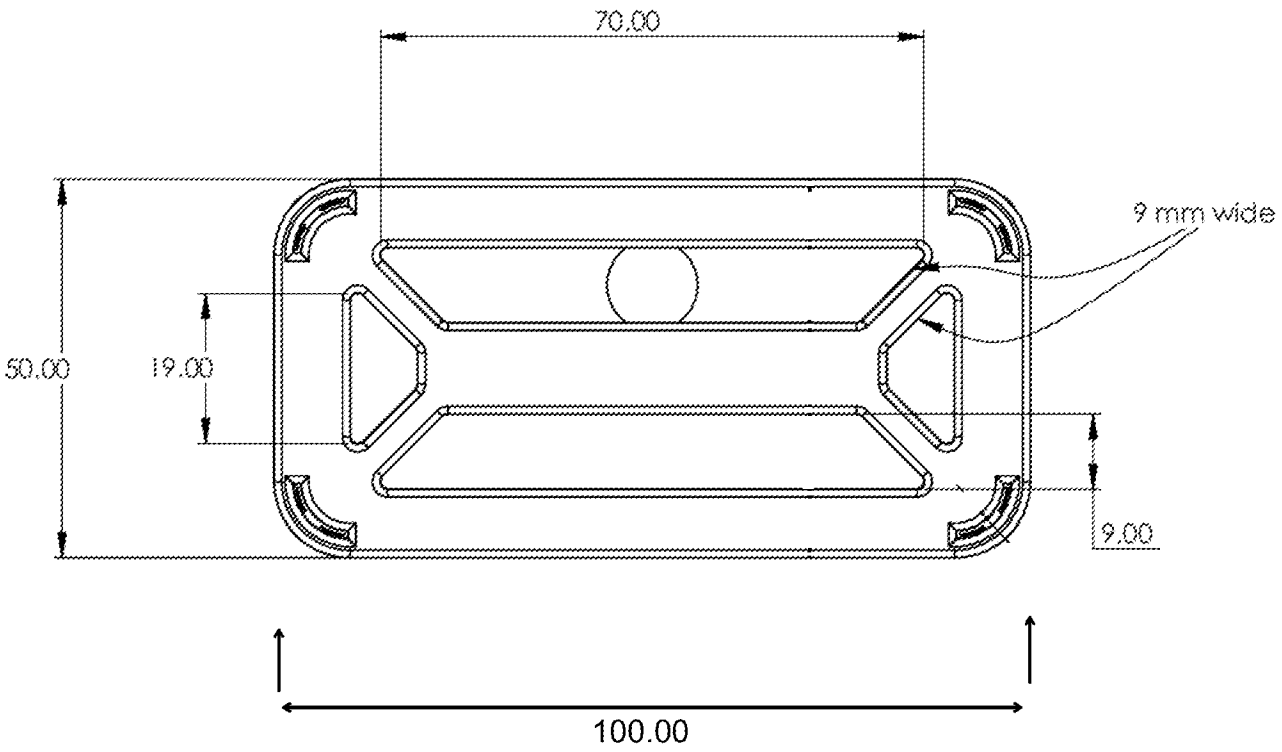
FIG. 16 is a view illustrating exemplary dimensions in a particular embodiment.

Suitable dimensions of an exemplary device of FIG. 1 are shown with reference to in FIG. 16, where the overall case dimensions are width of 50 mm by length of 100 mm. The channel openings 14, 14' are suitably 9 mm. Rectangular magnet 30 suitably is 10 mm wide by 60 mm long, and 3 mm thick. Circular magnet 32 is suitably 12 mm diameter and 2 mm thick. The channel defined inside the case in which magnet 32 travels is 3.25 mm deep and 12.5 mm wide.

An aspect of the device is viewing the rolling magnet/member to allow for more types of interaction while being low profile enough to fit into the palm of a user's hand. There is a tolerance given in the channel for where the rolling magnet is positioned for spacing between the magnet and walls, allowing no friction between the rolling magnet and the enclosure overhang walls.

The case can be made of an array of different additive and subtractive manufacturing processes including, but not limited to; injection molded plastic, 3D printed plastic, subtractive cutting of wood, metal or plastic, for example.

Since the device in a preferred embodiment is relatively small and has a strong magnet inside, the entire device can be magnetically mounted to metal or another magnet and self suspend itself for storage when not in use.

While a preferred embodiment of the technology has been shown and described, it will be apparent to those skilled in the art that many changes and modifications may be made without departing from the broader aspects. The appended claims are therefore intended to cover all such changes and modifications as fall within the true spirit and scope of the technology.

What is claimed is:

1. A magnetic track toy, comprising:

a first magnet comprising a track around a periphery thereof, said first magnet having a first north polarity plane and a first south polarity plane such that said track exhibits both the north and south planes along a track face thereof;

a second magnet having a circular profile and said second magnet having a second north polarity plane and a second south polarity plane such that said second magnet exhibits both the north and south planes along a peripheral face thereof, wherein the peripheral face of said second magnet is rollingly positioned adjacent the track face of said first magnet with the north polarity plane of said second magnet adjacent said south polarity plane of said first magnet and said south polarity plane of said second magnet adjacent said north polarity plane of said first magnet; and a case for holding said first and second magnets relative to one another, said case defining a channel in which said second magnet travels when moving in the track of the first magnet, for containing said second magnet in said case.

2. The magnetic track toy according to claim 1, wherein said case maintains said second magnet therein in a rollable configuration while maintaining said second magnet from escaping from within said case.

3. The magnetic track toy according to claim 2, wherein said case has openings defined therein for observing said second magnet.

4. The magnetic track toy according to claim 2, wherein said case has openings defined therein for interacting with said second magnet.

5. The magnetic track toy according to claim 1, wherein said case comprises a rectangular shaped profile.

6. The magnetic track toy according to claim 1, wherein said first magnet comprises a rectangular shaped profile.

7. The magnetic track toy according to claim 1, wherein said second magnet comprises a disk shaped profile.

8. The magnetic track toy according to claim 1, wherein said case comprises an ovular shape profile.

9. The magnetic track toy according to claim 1, wherein said second magnet comprises a spherical shaped profile.

10. The magnetic track toy according to claim 9, wherein said first magnet comprises an ovular shaped profile.

11. The magnetic track toy according to claim 1, wherein said case comprises a round shaped profile.

12. The magnetic track toy according to claim 11, wherein said first magnet comprises a round shaped profile.

13. A track toy, comprising:

a case adapted for holding in a hand of a user and defining a rolling track therewithin, said case having interior walls;

a fixed magnet fixedly mounted in said case said first magnet defining a rolling seat around a periphery thereof, said first magnet having a first north polarity plane and a first south polarity plane such that said rolling seat exhibits both the north and south planes along a face thereof;

a rolling magnet having a circular profile and said rolling magnet having a second north polarity plane and a second south polarity plane such that said second magnet exhibits both the north and south planes along a peripheral face thereof, wherein the peripheral face of said rolling magnet is positioned adjacent the rolling seat of said fixed magnet with the north polarity plane of said rolling magnet adjacent said south polarity plane of said fixed magnet and said south polarity plane of said second magnet adjacent said north polarity plane of said first magnet, whereby said rolling magnet is able to roll along the rolling seat while being contained within the rolling track of said case by said interior walls of said case.

14. The track toy according to claim 13, wherein said case comprises first and second opposite faces and portions of at least one of said first and second opposite faces are provided with one or more openings such that said rolling magnet can be observed from an outside of the case.

15. The track toy according to claim 13, wherein said case comprises a rectangular shaped profile and wherein said fixed magnet comprises a rectangular shaped profile.

16. The track toy according to claim 13, wherein said second magnet comprises a spherical shaped profile.

17. The track toy according to claim 13, wherein said second magnet comprises a disk shaped profile.

18. The track toy according to claim 13, wherein said case comprises an ovular shape profile.

19. The track toy according to claim 18, wherein said first magnet comprises an ovular shaped profile.

20. The track toy according to claim 13, wherein said case comprises a round shaped profile.

21. The track toy according to claim 20, wherein said first magnet comprises a round shaped profile.

22. The track toy according to claim 13, wherein said case comprises first and second opposite faces and portions of at least one of said first and second opposite faces are provided with one or more openings such that said rolling magnet can be interacted with from an outside of the case.

* * * * *